United States Patent [19]

Chen

[11] Patent Number: 4,917,168

[45] Date of Patent: Apr. 17, 1990

[54] ANGLE-CONTROLLING DEVICE FOR A VENETIAN BLIND

[76] Inventor: Cheng-Hsiung Chen, No. 32, Chin-Hua N. Rd., Pei-Tun Dist. Taichung City, Taiwan

[21] Appl. No.: 410,264

[22] Filed: Sep. 21, 1989

[51] Int. Cl.[4] ..... E06B 9/26

[52] U.S. Cl. ..... 160/176.1; 160/177; 464/40

[58] Field of Search ..... 160/177, 176.1, 178.1; 464/40

[56] References Cited

U.S. PATENT DOCUMENTS

| | | | |
|---|---|---|---|
| 3,156,295 | 11/1964 | Vecchiarelli et al. | 160/177 X |
| 3,180,400 | 4/1965 | Rau | 160/176.1 |
| 3,893,554 | 7/1975 | Wason | 464/40 X |
| 4,200,135 | 4/1980 | Hennequin | 160/176.1 X |
| 4,676,292 | 6/1987 | Valle et al. | 160/176.1 |

FOREIGN PATENT DOCUMENTS

| | | | |
|---|---|---|---|
| 0263311 | 7/1968 | Austria | 160/176.1 |

*Primary Examiner*—Blair M. Johnson

*Attorney, Agent, or Firm*—Harness, Dickey & Pierce

[57] ABSTRACT

A venetian blind includes a superposed series of horizontal slats suspended one above another, a bottom rail disposed below the slats, and two angle-controlling devices disposed at two end portions of the series of slats. Each of the angle-controlling devices includes a rotatable pulley disposed above the slats and provided with an annular groove, two tilting cords respectively connected to two sides of each of the slats, and a coiled spring sleeved tightly on the pulley within the annular groove which has two ends to which the top ends of the tilting cords are respectively fastened. The bottom rail is attached to the bottom ends of the tilting cords. When the pulleys are rotated to a predetermined position, one end of each of the springs is moved radially outward due to the downward pull of the bottom rail, so that the springs are loosened from the pulleys.

1 Claim, 5 Drawing Sheets

ANGLE-CONTROLLING DEVICE FOR A VENETIAN BLIND

BACKGROUND OF THE INVENTION

This invention relates to a venetian blind, more particularly to a reliable and durable angle-controlling device for a venetian blind.

Referring to FIG. 1, a conventional venetian blind 10 includes a horizontal support 11 with a U-shaped cross-section, a rotating shaft 12 journalled on the support 11, two rotating wheels 13 sleeved rigidly on the shaft 12, a driving unit 14 consisting of a worm and a worm gear, a superposed series of horizontal slats 15, a bottom rail 15A disposed below the slats 15, two sets of two tilting cords 16, a pair of pull cords 17, 18, and a rotatable rod 19 actuatable manually to rotate the shaft 12 via the driving unit 14. The pull cords 17, 18 extend through the vertically aligned openings of the slats 15 to fasten to the bottom rail 15A. After the pull cords 17, 18 have been manipulated to move the bottom rail 15A to a desired point, a quick lock means 1A is activated to position the bottom rail 15A relative to the support 11. As shown in FIG. 2, each of the rotating wheels 13 consists of two tubular elements 131 sleeved rigidly on the shaft 12. The tilting cords 16 are clamped tightly between the tubular elements 131 so that the rotation of the shaft 12 can cause the tilting cords 16 to move up and down. Referring to FIG. 3, an alternative conventional rotating wheel is provided in the form of a single tubular element 13' with a hole 131' formed therethrough. One end of each of the tilting cords 16' is secured in a hole 131' of the tubular element 13'. When the rotatable rod 19 is inadvertently rotated several revolutions, the tilting cords 16, 16' are wound on the rotating wheel 13, 13', thereby resulting in either the angle of the slats 15 being uncontrollable or the breakage of the tilting cords 16, 16'.

SUMMARY OF THE INVENTION

It is therefore the main object of this invention to provide a venetian blind with reliable and durable angle-controlling devices.

According to this invention, a venetian blind includes a superposed series of horizontal slats suspended one above another, a bottom rail disposed below the slats, and two angle-controlling devices disposed at two end portions of the series of slats. Each of the angle-controlling devices includes a rotatable pulley disposed above the slats and provided with an annular groove, two tilting cords respectively connected to two sides of each of the slats, and a coiled spring which is sleeved tightly on the pulley within the annular groove and has two ends to which the top ends of the tilting cords are respectively fastened. The bottom rail is attached to the bottom ends of the tilting cords. When the pulleys are rotated to a predetermined position, one end of each of the springs is moved radially outward due to the downward pull of the bottom rail, so that the springs are loosened from the pulleys. Therefore, when the pulleys continue to rotate in the same direction, the springs are no longer rotated so as to prevent the breakage of the tilting cords.

BRIEF DESCRIPTION OF THE DRAWINGS

Other features and advantages of this invention will become apparent in the following detailed description of a preferred embodiment of this invention, with reference to the accompanying drawings, in which.

DETAILED DESCRIPTION OF THE PREFERRED EMBODIMENT

Figure 1:
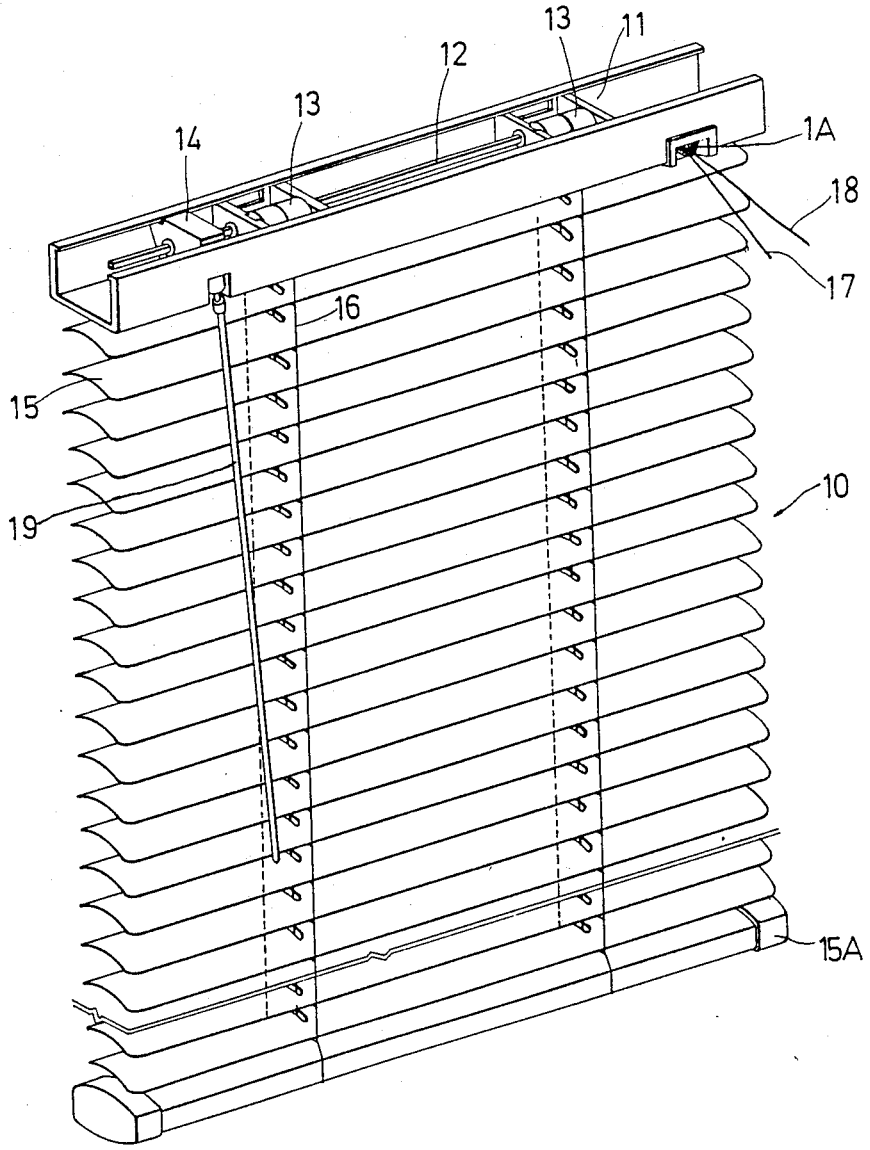
FIG. 1 PRIOR ART
FIG. 1 is a perspective view of a conventional venetian blind.
Figure 2:
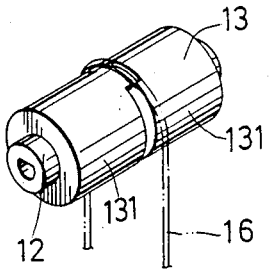
FIG.2 PRIOR ART
FIG. 2 is a perspective view showing the angle-controlling device of a conventional venetian blind.
Figure 3:
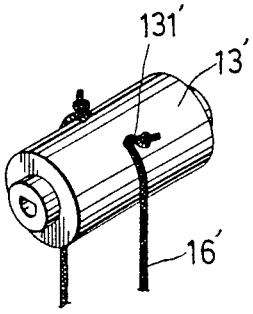
FIG.3 PRIOR ART
FIG. 3 is a perspective view of another conventional angle-controlling device.
Figure 4:
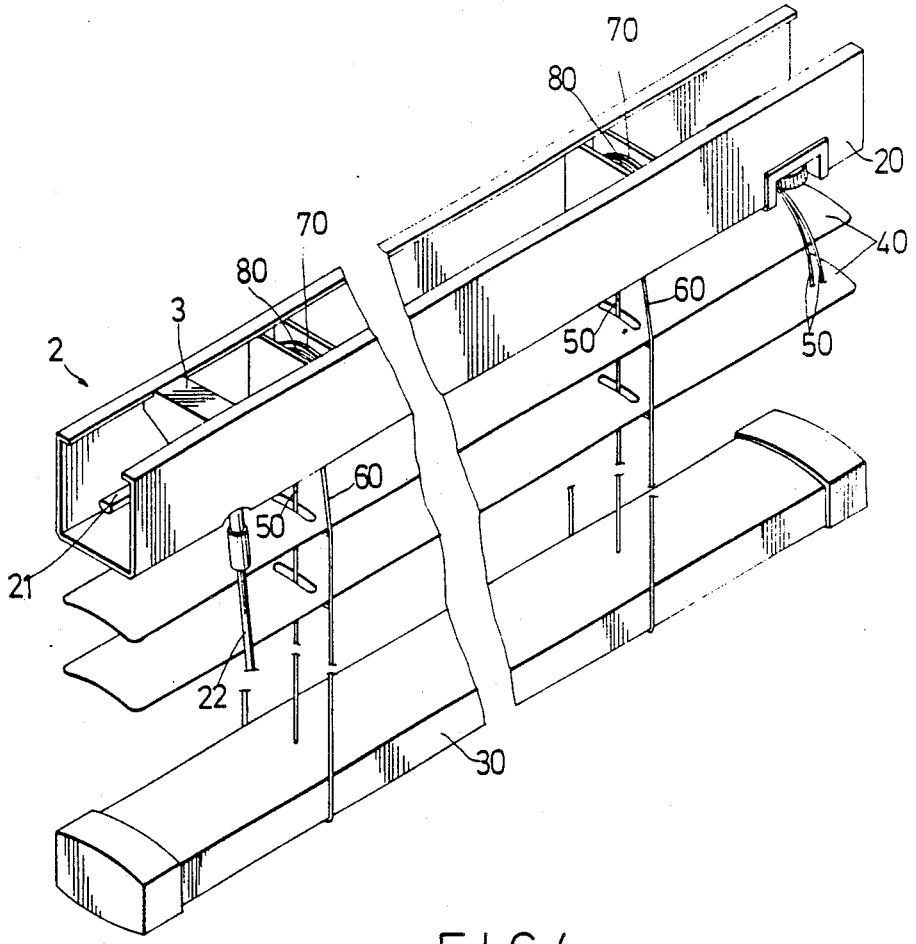
FIG. 4 is a perspective view of a venetian blind according to this invention.
Figure 5:
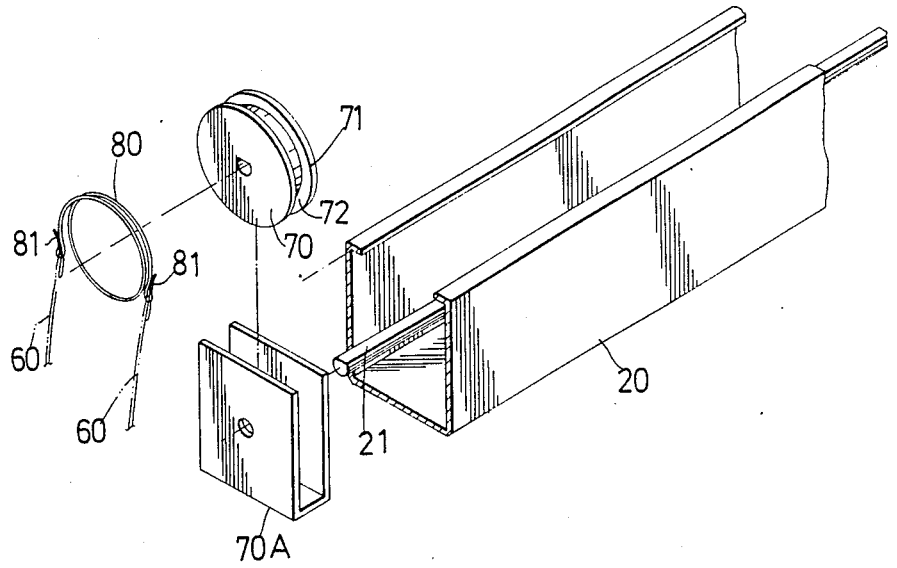
FIG. 5 is an exploded view showing the angle-controlling device of the venetian blind according to this invention.
Figure 6:
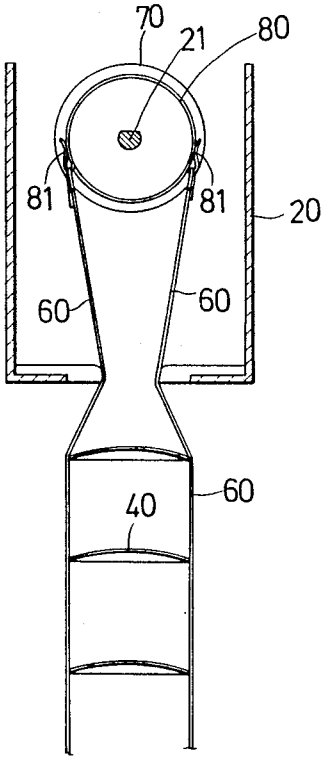
FIG. 6 is a sectional view showing the angle-controlling device of the venetian blind according to this invention.

Referring to FIGS. 4–6, a venetian blind 2 of this invention includes a horizontal support 20 which has a U-shaped cross-section, a bottom rail 30, a superposed series of horizontal slats 40, a pair of pull cords 50 extending through the vertically aligned openings of the slats 40, and two sets of two tilting cords 60. Each set of the adjacent tilting cords 60 are respectively connected to two sides of each of the slats 40.

A rotating shaft 21 which has a semicircular cross-section is journalled on the support 20 and extends through the semicircular holes of two rotatable pulleys 70 which are positioned on the support 20 by means of U-shaped brackets 70A. A rotatable rod 22 is connected to the shaft 21 in a known manner by means of a driving unit 3 which consists of a worm and a worm gear. Each of the pulleys 70 has two outward flanges 71 between which an annular groove 72 is formed. Two coiled springs 80, of about one and two-thirds turns, are sleeved tightly on the respective pulleys 70 within the annular grooves 72 so as to rotate synchronously with the pulleys 70. Accordingly, when the rod 22 is rotated, the driving unit 3 rotates the pulleys 70 and the springs 80. The top ends of the tilting cords 60 are fastened to the ends 81 of the springs 80, which are normally at the same level so that the slats 40 are horizontal, thereby permitting the direct passage of rays of light.

Figure 7:
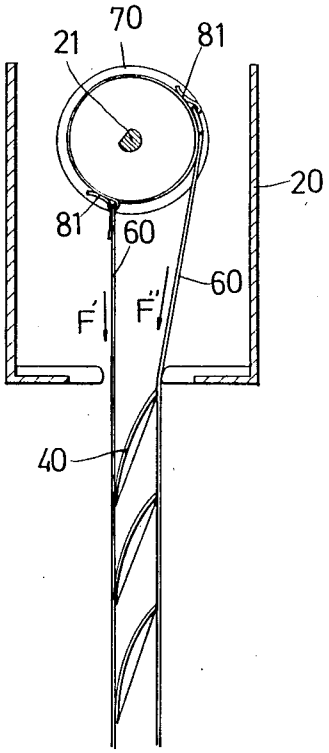
FIG. 7 is a schematic view illustrating the operation of the angle-controlling device according to this invention.

In use, when the spring 80 is rotated to the position shown in FIG. 7, in which the spring ends 81 are at different levels, a lower spring end 81 suffers the downward pull (F') of the tilting cords 22, the slats 40 and the bottom rail 30, which is greater than the downward pull (F'') suffered by an upper spring end 81, and which moves the lower spring end 81 radially outward. As soon as the downward pull (F') overcomes the gripping force of the spring 80 on the pulley 70, the spring 80 is loosened from the pulley 70. Subsequently, when the pulley 70 continues to rotate in the same direction, the spring 80 is no longer rotated therewith.

With the springs 80 automatically locked releasably on the pulleys 70, when the rod 22 is rotated to too great an angle, the malfunction and breakage of the tilting cords 60 are prevented. Therefore, the angle-controlling device consisting of the tilting cords 60, the pulley 70 and the spring 80 is reliable and durable.

With this invention thus explained, it is apparent that numerous modifications and variations can be made without departing from the scope and spirit of this invention. It is therefore intended that this invention be limited only as indicated in the appended claims.

I claim:

1. A venetian blind including a superposed series of horizontal slats suspended one above another, a bottom rail disposed below said slats, and two angle-controlling devices disposed at two end portions of said series of slats, each of said angle-controlling devices including a rotatable means disposed at a top end portion of said blind, and two tilting cords respectively connected to two sides of each of said slats, said bottom rail being attached to bottom ends of said tilting cords, characterized in that each of said rotatable means includes a rotatable pulley having an annular groove formed therein, and a coiled spring sleeved tightly on said pulley within said annular groove, each of said springs having two ends to which top ends of two associated said tilting cords are respectively fastened, whereby, when said pulleys are rotated to a predetermined position, one end of each of said springs is moved radially outward due to downward pull of said bottom rail, so that said springs are loosened from said pulleys.

* * * * *